US005957171A

United States Patent [19]

Matsuo

[11] Patent Number: 5,957,171

[45] Date of Patent: Sep. 28, 1999

[54] PRESSURE FILLING METHOD AND APPARATUS FOR LIQUID

[75] Inventor: Noriyuki Matsuo, Ishikawa-Ken, Japan

[73] Assignee: Shibuya Kogyo Co., Ltd., Ishikawa-ken, Japan

[21] Appl. No.: 09/079,240

[22] Filed: May 14, 1998

[30] Foreign Application Priority Data

Sep. 19, 1997 [JP] Japan ..... 9-273901

[51] Int. Cl.[6] ..... B65B 1/04

[52] U.S. Cl. ..... 141/83; 141/95; 141/192

[58] Field of Search ..... 141/83, 95, 192, 141/198, 153, 188

[56] References Cited

U.S. PATENT DOCUMENTS

| | | | |
|---|---|---|---|
| 5,105,859 | 4/1992 | Bennet et al. | 141/188 |
| 5,513,678 | 5/1996 | Schultz et al. | 141/83 |
| 5,819,816 | 10/1998 | Mayer | 141/83 |

FOREIGN PATENT DOCUMENTS

| | | |
|---|---|---|
| 1-46392 | 10/1989 | Japan . |
| 9-2583 | 1/1997 | Japan . |

*Primary Examiner*—Steven O. Douglas
*Attorney, Agent, or Firm*—Flynn, Thiel, Boutell & Tanis, P.C.

[57] ABSTRACT

A pressure filling method and a filling apparatus which fills a given quantity of liquid medicine, for example, into ampoules under pressure. A controller 8 initially opens open/close valves 13 of filling mechanisms 7 to commence the filling of liquid medicine 3 into ampoules 2 from nozzles 14. The liquid pressure of liquid medicine 3 is measured at a given time interval by a liquid pressure sensor 15, and is input to the controller 8. The controller 8 determines a mean value of liquid pressure at the end of each measurement on the basis of liquid pressures which are input during each measurement from the liquid pressure sensor 15, and calculates a predicted time for completion of filling on the basis of liquid pressures obtained at the end of each measurement. The predicted times for completion of filling thus determined at the end of each measurement are averaged to provide a corrected predicted time for completion of filling. When the time passed since the commencement of filling reaches the corrected predicted time for completion of filling, the controller 8 closes the open/close valves. This allows a variation in the filling of liquid medicine 3 from ampoule to ampoule to be suppressed.

14 Claims, 2 Drawing Sheets

PRESSURE FILLING METHOD AND APPARATUS FOR LIQUID

FIELD OF THE INVENTION

The invention relates to a pressure filling method and a filling apparatus for liquid, and more particularly, to a pressure filling method and a filling apparatus in which a pressure is applied to a liquid medicine, for example, to be filled into an ampoule.

DESCRIPTION OF THE PRIOR ART

A pressure filling method which applies a pressure to a liquid medicine to fill an ampoule is known in the art (see, for example, Japanese Patent Publication No. 46,392/1989). In the filling method disclosed in this citation, a predicted time for completion of filling when a given quantity of liquid to be filled will have filled a vessel is calculated on the basis of a liquid pressure at the commencement of a filling operation, and the filling operation by a filling mechanism is terminated when the predicted time passes.

This filling method has a drawback that a variation in the filling occurs from vessel to vessel in the event of a fluctuation in the liquid pressure after the commencement of the filling operation. To eliminate such a drawback, a filling method is proposed in Japanese Laid-Open Patent Application No. 2,583/1997 in which the liquid pressure is measured at a given time interval after the commencement of the filling operation, and the filling in each interval is calculated. The fillings of individual intervals are successively added together, and when the sum exceeds a preset filling, the filling of the liquid into the vessel is stopped.

However, in the method disclosed in the second citation, the filling is stopped after the added sum exceeds the preset filling, so that there is a drawback that the filling in the vessel is always greater than the preset filling upon termination of the filling operation. In addition, where the time interval between the measurements is longer, there results another drawback that an error in the quantity of liquid filled in the vessel becomes greater after the completion of the filling operation.

SUMMARY OF THE INVENTION

In view of the foregoing, in accordance with the invention, in a pressure filling method for liquid in which a filling of liquid into a vessel is commenced under a condition that a pressure is applied to the liquid, a predicted time for completion of filling when a given quantity of liquid to be filled will have filled a vessel is calculated on the basis of a predetermined function of a liquid pressure and a filling time, and the filling of liquid into the vessel is stopped when the time passed since the commencement of filling reaches the predicted time for completion of filling, the method comprises the steps of measuring the liquid pressure at successive points after the commencement of filling the liquid into the vessel, determining mean values of the liquid pressure from these measurements, calculating and recalculating a plurality of times a predicted time for completion of filling when a given quantity of liquid to be filled will have filled a vessel on the basis of the mean values, averaging the predicted times thus determined to provide a corrected predicted time for completion of filling, and stopping the filling of liquid into the vessel when the time passed since the commencement of filling reaches the corrected predicted time for completion of filling.

According to a second aspect of the invention, in a pressure filling method for liquid in which a filling of liquid into a vessel is commenced under a condition that a pressure is applied to the liquid, a predicted time for completion of filling when a given quantity of liquid to be filled will have filled a vessel is calculated on the basis of a predetermined function of a liquid pressure and a filling time, and the filling of liquid into the vessel is stopped when the time passed since the commencement of filling reaches the predicted time for completion of filling, the method comprises the steps of measuring the liquid pressure at successive points after the commencement of filling the liquid into the vessel, calculating and recalculating a plurality of times a predicted time for completion of filling when a given quantity of liquid to be filled will have filled a vessel on the basis of the measurements, averaging the predicted times for completion of filling which are calculated and recalculated a number of times to provide a corrected predicted time for completion of filling, and stopping the filling of liquid into the vessel when the time passed since the commencement of filling reaches the corrected predicted time for completion of filling.

According to a third aspect of the invention, in a pressure filling method for liquid in which a filling of liquid into a vessel is commenced under a condition that a pressure is applied to the liquid, a predicted time for completion of filling when a given quantity of liquid to be filled will have filled a vessel is calculated on the basis of a predetermined function of a liquid pressure and a filling time, and the filling of liquid into the vessel is stopped when the time passed since the commencement of filling reaches the predicted time for completion of filling, the method comprises the steps of measuring the liquid pressure at successive points after the commencement of filling the liquid into the vessel, determining a mean value of liquid pressures previously measured at the end of each measurement, determining a predicted time for completion of filling when a given quantity of liquid to be filled will have filled a vessel on the basis of the mean values, and stopping the filling of liquid into the vessel when the time passed since the commencement of filling reaches the predicted time for completion of filling.

According to a fourth aspect of the invention, in a filling apparatus including a pressure tank serving as a reservoir of liquid, means for pressurizing the liquid in the pressure tank, a plurality of filling mechanisms each in communication with the pressure tank and each having an open/close valve, a controller for controlling the operation of the filling mechanisms, and a liquid pressure sensor for detecting the liquid pressure and feeding it to the controller, the controller opening the open/close valves of the plurality of filling mechanisms to commence a filling of liquid into vessels, calculating for each filling mechanism a predicted time for completion of filling when a given quantity of liquid to be filled will have filled a vessel on the basis of a predetermined function of a liquid pressure and a filling time, and stopping the filling of liquid into the vessel by closing the open/close valve of the associated filling mechanism when the time passed since the commencement of filling reaches the predicted time for completion of filling, the controller measuring the liquid pressure at successive points after the commencement of filling the liquid into the vessel, determining a mean valve of liquid pressures from these measurements, calculating and recalculating a plurality of times a predicted time for completion of filling when a given quantity of liquid to be filled will have filled a vessel on the basis of the mean values, averaging the predicted times for completion of filling thus calculated to provide a corrected predicted time for completion of filling, and stopping the filling of liquid into the vessel when the time passed since the commencement of filling reaches the corrected predicted time for completion of filling.

According to a fifth aspect of the invention, in a filling apparatus including a pressure tank serving as a reservoir of liquid, means for pressurizing the liquid in the pressure tank, a plurality of filling mechanisms each in communication with the pressure tank and each having an open/close valve, a controller for controlling the operation of the filling mechanisms, and a liquid pressure sensor for detecting the liquid pressure and feeding it to the controller, the controller opening the open/close valves of the plurality of filling mechanisms to commence a filling of liquid into vessels, calculating for each filling mechanism a predicted time for completion of filling when a given quantity of liquid to be filled will have filled a vessel on the basis of a predetermined function of a liquid pressure and a filling time, and stopping the filling of liquid into the vessel by closing the open/close valve of the associated filling mechanism when the time passed since the commencement of filling reaches the predicted time for completion of filling, the controller measuring the liquid pressure at successive points after the commencement of filling the liquid into the vessel, calculating and recalculating a predicted time for completion of filling when a given quantity of liquid to be filled will have filled a vessel on the basis of the pressures measured, averaging the predicted times for completion of filling thus recalculated at the end of each measurement to provide a corrected predicted time for completion of filling, and stopping the filling of liquid into the vessel when the time passed since the commencement of filling reaches the corrected predicted time for completion of filling.

Finally, according to a sixth aspect of the invention, in a filling apparatus including a pressure tank serving as a reservoir of liquid, means for pressurizing the liquid in the pressure tank, a plurality of filling mechanisms each in communication with the pressure tank and each having an open/close valve, a controller for controlling the operation of the filling mechanisms, and a liquid pressure sensor for detecting the liquid pressure and feeding it to the controller, the controller opening the open/close valves of the plurality of filling mechanisms to commence a filling of liquid into vessels, calculating for each filling mechanism a predicted time for completion of filling when a given quantity of liquid to be filled will have filled a vessel on the basis of a predetermined function of a liquid pressure and a filling time, and stopping the filling of liquid into the vessel by closing the open/close valve of the associated filling mechanism when the time passed since the commencement of filling reaches the predicted time for completion of filling, the controller measuring the liquid pressure at successive points after the commencement of filling the liquid into the vessel, determining a mean value of liquid pressures previously measured at the end of each measurement, determining a predicted time for completion of filling when a given quantity of liquid to be filled will have filled a vessel on the basis of the mean values, and stopping the filling of liquid into the vessel when the time passed since the commencement of filling reaches the predicted time for completion of filling.

With the invention described above, if there is a fluctuation in the liquid pressure after the commencement of filling, the filling operation is terminated when the time passed since the commencement of filling reaches the corrected predicted time for completion of filling, thus allowing a variation in the filling of liquid to be filled from vessel to vessel to be suppressed.

Accordingly, it is possible to maintain a higher accuracy in the filling of liquid to be filled into a vessel than in the prior art.

Above and other and objects, features and advantages of the invention will become apparent from the following description with reference to the drawings.

DETAILED DESCRIPTION OF THE EMBODIMENT

Figure 1:
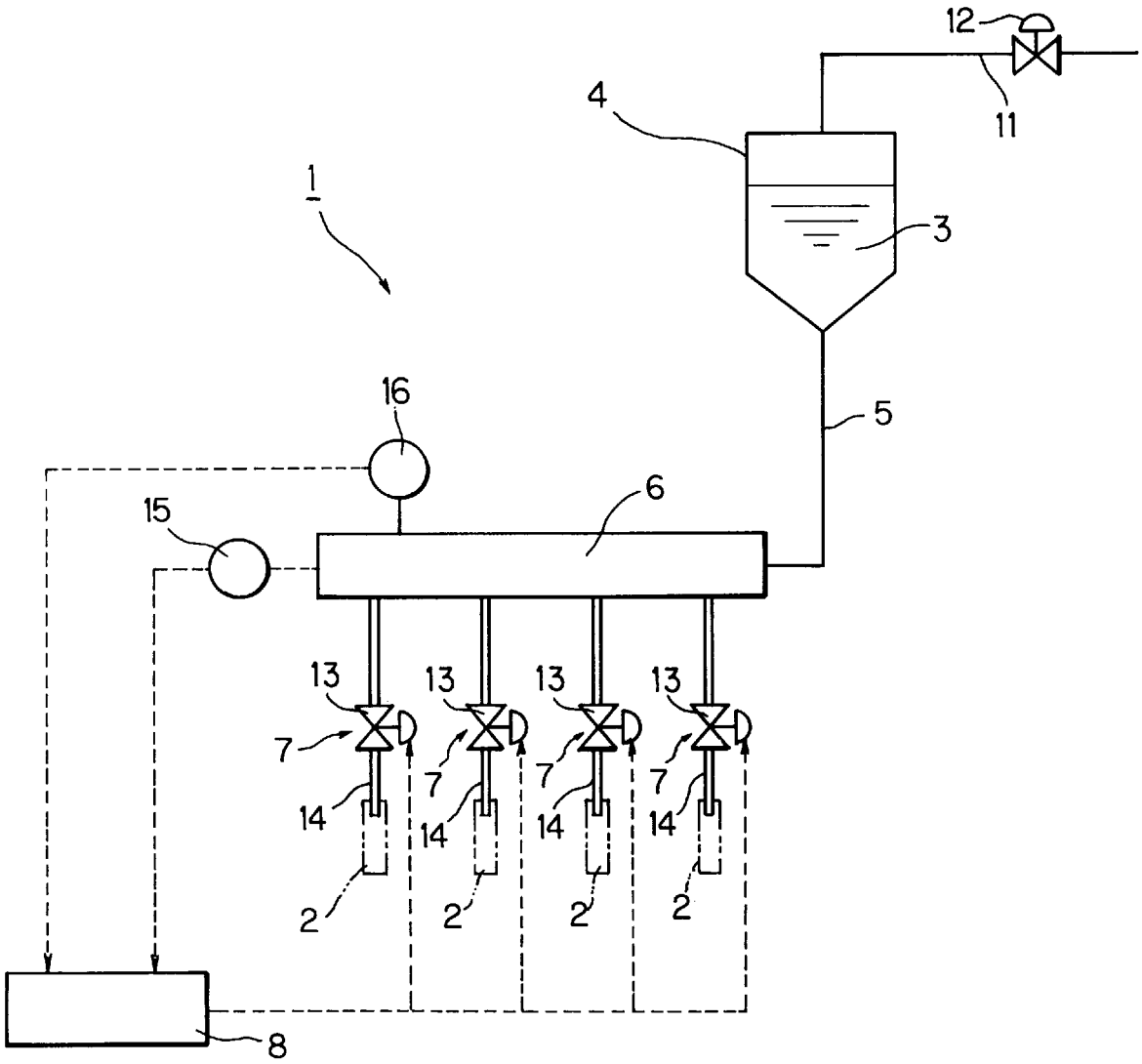
FIG. 1 is a schematic view of one embodiment of the invention.

The invention will now be described with reference to an embodiment shown in the drawings wherein a filling apparatus 1 is designed to fill a vessel in the form of an ampoule 2 with a given quantity of liquid medicine 3.

The filling apparatus 1 comprises a pressure tank 4 serving as a reservoir of liquid medicine 3, a distributing header 6 communicating with the pressure tank 4 through a conduit 5, a plurality of filling mechanisms 7 connected to the header 6, and a controller 8 controlling the operation of these filling mechanisms 7.

One end of a conduit 11 is connected to the pressure tank 4, and the other end of the conduit 11 is connected to a source of compressed air, not shown. A pressure regulator valve 12 is disposed in the conduit 11 to allow a compressed air of substantially constant pressure to be introduced into the pressure tank 4. In this manner, the liquid medicine 3 within the pressure tank 4 and the distributing header 6 is maintained under a substantially constant liquid pressure.

Each filling mechanism 7 includes an open/close valve 13 and a nozzle 14 which is inserted into the ampoule 2, the opening and closing of the open/close valve 13 being controlled by the controller 8.

A liquid pressure sensor 15 which detects the pressure of the liquid medicine 3 within the header 6 is mounted on the header 6, and normally feeds the detected liquid pressure within the header 6 to the controller 8. A liquid temperature sensor 16 which detects the temperature of the liquid medicine 3 stored within the header 6 is also mounted on the header, and also normally feeds the detected liquid temperature to the controller 8.

When the nozzles 14 of the filling mechanisms 7 are inserted into the ampoules 2, the controller 8 causes the respective open/close valves 14 to be opened in synchronism, whereupon the filling of liquid medicine 3 into the ampoules 2 is commenced. The controller 8 stores a predetermined function of the liquid pressure of liquid medicine 3 and a filling time for each filling mechanism 7, and calculates a predicted time for completion of filling when a given quantity of liquid medicine 3 will have filled each ampoule 2 on the basis of the liquid pressure which prevails at the time the respective open/close valves 13 are opened, and stops the filling of each ampoule 2 by closing the respective open/close valves 13 when the time passed since the commencement of filling reaches the predicted time for completion of filling.

The present embodiment premises the described construction, and improves the method of controlling the respective open/close valves 13 by the controller 8 so that a variation in the filling of liquid medicine 3 from ampoule 2 to ampoule 2 may be suppressed if a fluctuation occurs in the liquid pressure of the liquid medicine 3 after the commencement of filling.

Figure 2:
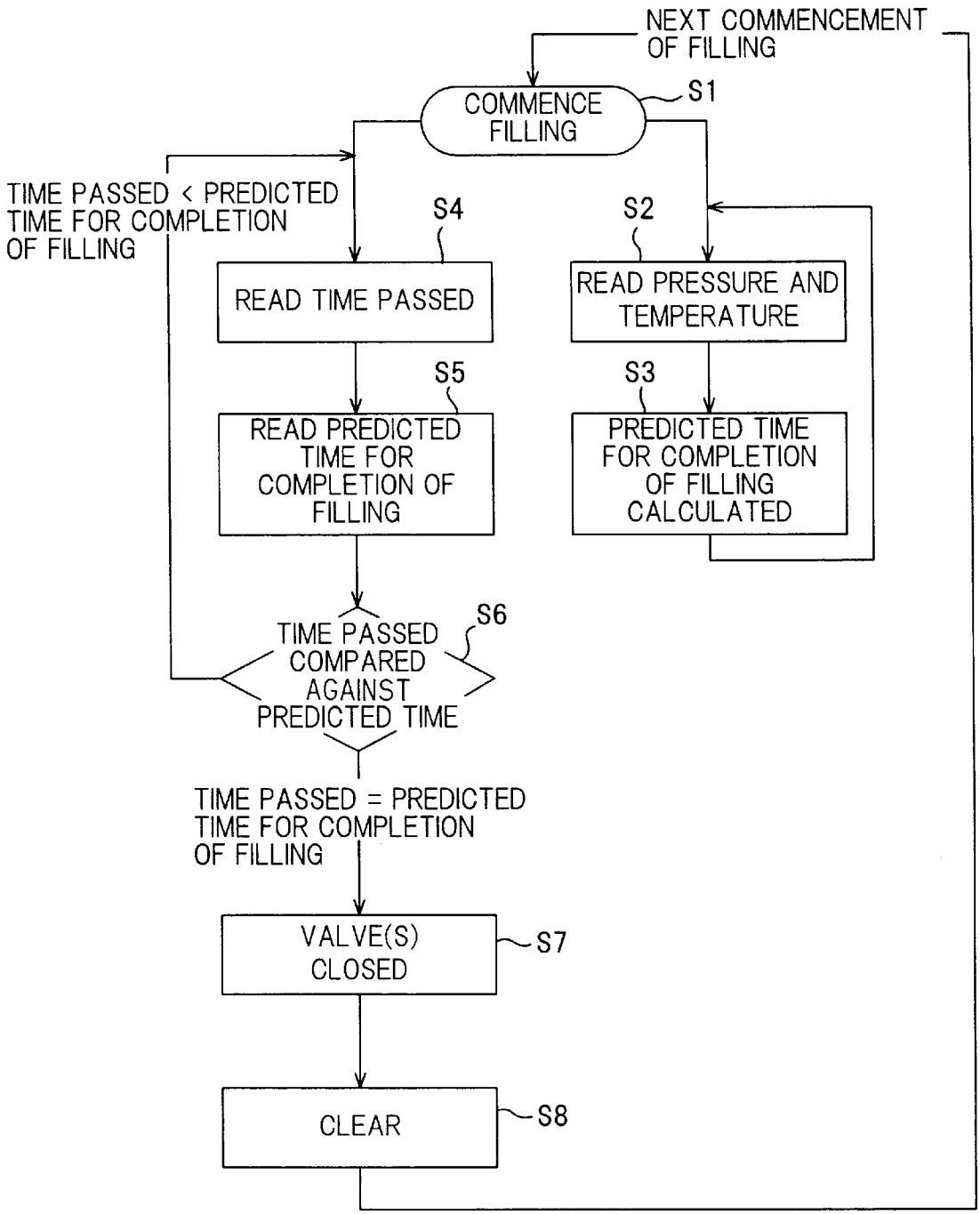
FIG. 2 is a flow diagram illustrating processing steps by controller 8 shown in FIG. 1.

Specifically, the controller 8 controls the operation of the open/close valve 13 of each filling mechanism 7 as follows:

As indicated in FIG.2, the controller 8 initially causes the respective open/close valves 13 to be opened in synchronism, thus commencing the filling of liquid to be filled into the ampoules 2 (S1).

At the time the filling operation is commenced, the controller 8 reads the liquid pressure measured by the liquid pressure sensor 15 (S2), calculates a predicted time for completion of filling tx on the basis of a predetermined function of a liquid pressure of liquid medicine 3 and a filling time and stores it (S3).

After calculating the predicted time tx for completion of filling for the first pass, the controller 8 reads the liquid pressure measured by the liquid pressure sensor 15 after a given time interval (which may be 7/100 second, for example) passes (S2), and on the basis of this liquid pressure, calculates a predicted time for completion of filling for the second pass from the function mentioned above, and stores the corrected expected time for completion of filling tx which is now calculated (S3).

In this manner, after the commencement of filling, the controller 8 reads the liquid pressure measured by the liquid pressure sensor 15 after each interval (which may be 7/100 second, 10/100 second, 8/100 second, for example) passes, and successively determines and stores a corrected expected time for completion of filling tx.

Specifically, a predicted time for completion of filling tx for second and subsecond pass is calculated in the manner mentioned below. Thus, as the liquid pressure is measured by the liquid pressure sensor 15 after each interval, a mean value, px1–pxn, of liquid pressures is determined on the basis of the measurements, and a predicted time t for completion of filling when a given quantity of liquid to be filled will have filled the ampoule 2 is calculated on the basis of these mean values.

Denoting liquid pressures which are successively input to the controller 8 from the liquid pressure sensor 15 by p1, p2, p3, . . . pn, the mean values px of liquid pressures are determined as follows:

$$px1=(p1+p2)/2 \ldots t1$$

$$px2=(p2+p3)/2 \ldots t2$$

$$px3=(p3+p4)/2 \ldots t3$$

In other words, two consecutive results of measurements are averaged to provide successive mean value px1–pxn of liquid pressures, and a predicted time for completion of filling t1–tn is calculated.

Subsequently, predicted times t1–tn for completion of filling which are determined at the end of individual measurements are averaged out to provide a corrected predicted time for completion of filling tx.

At the same time as the described operation is performed after the commencement of filling, the controller 8 continuously determines the time passed since the commencement of filling by an internally housed timer (S4).

At the same time, the controller 8 continually reads the predicted time for completion of filling tx which is successively updated as the time goes on after the commencement of filling (S5).

Also at the same time therewith, the controller 8 continually compares the time passed since the commencement of filling, which is determined by the timer, against the predicted time for completion of filling tx (S6).

If the time passed since the commencement of filling does not reach the predicted time for completion of filling tx, the operation returns to S4, repeating the processing operations mentioned above in connection with S4 to S6.

On the other hand, when the time passed since the commencement of filling reaches the predicted time for completion of filling tx, the controller 8 stops the operation of the filling mechanisms 7 to terminate the filling operations (S7) if it is in the course of calculating the corrected predicted time for completion of filling.

At the same time, the controller 8 clears the time determined by the timer and the predicted time for completion of filling tx (S8).

Subsequently, the ampoules 4 which are filled are discharged from their positions below the filling mechanisms 7 while new ampoules 4 are supplied to the positions below the filling mechanisms. The controller 8 then controls the filling mechanisms 7 in the manner mentioned above, filling the new ampoules 4.

With the filling method mentioned above, if there is a fluctuation in the liquid pressure of liquid medicine 3 after the commencement of filling the liquid to be filled into the ampoules 2, a combination of the successive corrections of the predicted time for completion of filling and the continual comparison of the time passed since the commencement of filling against the corrected predicted time for completion of filling tx allows the filling operations to be stopped immediately upon reaching a coincidence between the time passed since the commencement of filling and the corrected predicted time for completion of filling tx. In this manner, an error between the actual filling of liquid medicine 3 in the ampoule 2 and a target value for the filling of liquid medicine 3 can be reduced. Accordingly, it is possible to achieve a high accuracy in the filling of liquid medicine 3 into the ampoules 2 as compared with the prior art.

It is to be understood that the mean values px1–pxn of liquid pressures may be provided each as a mean of three consecutive measurements, as illustrated below.

$$px1=(p1+p2+p3)/3 \ldots t1$$

$$px2=(p2+p3+p4)/3 \ldots t2$$

$$px3=(p3+p4+p5)/3 \ldots t3$$

Alternatively, mean values px1–pxn of liquid pressures may be provided as a mean of a previous mean value and a current measurement, as illustrated below.

$$px1=(p1+p2)/2 \ldots t1$$

$$px2=(px1+p3)/2 \ldots t2$$

$$px3=(px2+p4)/2 \ldots t3$$

$$px4=(px3+p5)/2 \ldots t4$$

Second Embodiment

A method of controlling respective open/close valves 13 by the controller 8 may takes place according to a second embodiment of the invention as follows:

After the commencement of filling the liquid medicine 3 into the ampoule 2 and as the liquid pressure of liquid medicine 3 as measured by the liquid pressure sensor 15 is successively input to the controller 8, the controller 8 recalculates a predicted time for completion of filling when a given amount of liquid medicine 3 will have filled the ampoule 2 on the basis of successive liquid pressure inputs.

The predicted time for completion of filling is calculated at the end of each measurement, and all of these predicted times for completion of filling are averaged to provide a corrected predicted time for completion of filling, and when the time passed since the commencement of filling reaches the corrected predicted time for completion of filling, the controller 8 may close the open/close valves 13 of the respective filling mechanisms 7, thus terminating the filling operations. Again, a similar function and effect are achieved as achieved in the first embodiment mentioned above.

Third Embodiment

A method of controlling the respective open/close valves 13 by the controller 8 according to a third embodiment of the invention may take place as follows:

After the commencement of filling the liquid medicine 3 into the ampoule 2, and as liquid pressure of the liquid medicine 3 as measured by the liquid pressure sensor 15 is successively input to the controller 8, the controller determines a mean value of liquid pressures of the liquid medicine 3 which have been measured up to that point on the basis of the successive liquid pressure inputs, and also determines a corrected predicted time for completion of filling when a given quantity of liquid medicine 3 will have filled the ampoule 2 on the basis of the mean values of liquid pressures. When the time passed since the commencement of filling reaches the corrected predicted time for completion of filling, the open/close valves 13 of the filling mechanisms 7 are closed to stop filling the liquid medicine 3 into the ampoules 2. The third embodiment achieves a similar function and effect as achieved by the first embodiment.

In each of the described embodiments, the controller 8 controls the operation of the respective open/close valves 13 on the basis of a predetermined function of a liquid pressure of liquid medicine 3 and a filling time, but the effect of the temperature of the liquid medicine 3 which is detected by the liquid temperature sensor 16 may be incorporated into this function. In this manner, a higher accuracy can be achieved in controlling the filling of liquid medicine 3.

In the described embodiments, the liquid pressure sensor 15 is mounted on the distributing header 6, but a plurality of liquid pressure sensors may be mounted on individual filling mechanisms 7, thus allowing the controller 8 to control the respective open/close valves 13 of the individual filling mechanisms 7 in accordance with fluctuations in the liquid pressure of the individual filling mechanisms 7.

While the invention has been shown and described above in connection with particular embodiments thereof, it should be understood that a number of changes, modifications and substitutions are possible therein from the above disclosure without departing from the spirit and scope of the invention defined by the appended claims.

What is claimed is:

1. A pressure filling method for liquid in which a filling of liquid into a vessel is commenced under a condition that a pressure is applied to the liquid, a predicted time for completion of filling when a given quantity of liquid to be filled will have filled a vessel is calculated on the basis of a predetermined function of a liquid pressure and a filling time, and the filling of liquid into the vessel is stopped when the time passed since the commencement of filling reaches the predicted time for completion of filling, comprising the steps of measuring a liquid pressure at successive points after the commencement of filling the liquid into the vessel;

determining a mean value of liquid pressures from the measurements;

calculating and recalculating a plurality of times a predicted time for completion of filling when a given quantity of liquid to be filled will have filled a vessel on the basis of the mean values;

averaging the predicted times for completion of filling thus calculated to provide a corrected predicted time for completion of filling;

and stopping the filling of liquid into the vessel when the time passed since the commencement of filling reaches the corrected predicted time for completion of filling.

2. A pressure filling method for liquid according to claim 1 in which the mean value is obtained by averaging a plurality of consecutive measurements.

3. A pressure filling method for liquid according to claim 1 in which the mean value is obtained by averaging a mean value over previous measurements and a current measurement.

4. A pressure filling method for liquid according to claim 1 in which the function also includes a contribution of a change in the liquid temperature.

5. A pressure filling method for liquid in which a filling of liquid into a vessel is commenced under a condition that a pressure is applied to the liquid, a predicted time for completion of filling when a given quantity of liquid to be filled will have filled a vessel is calculated on the basis of a predetermined function of a liquid pressure and a filling time, and the filling of liquid into the vessel is stopped when the time passed since the commencement of filling reaches the predicted time for completion of filling, comprising the steps of measuring a liquid pressure at successive points after the commencement of filling the liquid into the vessel;

calculating and recalculating a predicted time for completion of filling when a given quantity of liquid to be filled will have filled a vessel on the basis of the pressures measured;

averaging the predicted times for completion of filling which are calculated or recalculated at the end of each measurement to provide a corrected predicted time for completion of filling;

and stopping the filling of liquid into the vessel when the time passed since the commencement of filling reaches the corrected predicted time for completion of filling.

6. A pressure filling method for liquid according to claim 4 in which the function also includes a contribution of a change in the liquid temperature.

7. A pressure filling method for liquid in which a filling of liquid into a vessel is commenced under a condition that a pressure is applied to the liquid, a predicted time for completion of filling when a given quantity of liquid to be filled will have filled a vessel is calculated on the basis of a predetermined function of a liquid pressure and a filling time, and the filling of liquid into the vessel is stopped when the time passed since the commencement of filling reaches the predicted time for completion of filling, comprising the steps of measuring a liquid pressure at successive points after the commencement of filling the liquid into the vessel;

determining, at the end of each measurement, a mean value of liquid pressures which have been previously measured;

determining a predicted time for completion of filling when a given quantity of liquid to be filled will have filled the vessel on the basis of the mean value;

and stopping the filling of liquid into the vessel when the time passed since the commencement of filling reaches the predicted time for completion of filling.

8. A pressure filling method for liquid according to claims 7 in which the function also includes a contribution of a change in the liquid temperature.

9. A filling apparatus including a pressure tank serving as a reservoir of liquid, means for pressurizing the liquid in the pressure tank, a plurality of filling mechanisms each in communication with the pressure tank and each having an open/close valve, a controller for controlling the operation of the filling mechanisms, and a liquid pressure sensor for detecting the liquid pressure and feeding it to the controller, the controller opening the open/close valves of the plurality of filling mechanisms to commence a filling of liquid into vessels, calculating a predicted time for completion of filling when a given quantity of liquid to be filled will have filled a vessel on the basis of a predetermined function of a liquid pressure and a filling time and stopping the filling of liquid into the vessel by closing the open/close valve of the associated filling mechanism when the time passed since the commencement of filling reaches the predicted time for completion of filling, characterized in that the controller measures the liquid pressure at successive points after the commencement of filling the liquid into the vessel, determines a mean value of liquid pressures from the measurements, calculates and recalculates a plurality of times a predicted time for completion of filling when a given quantity of liquid to be filled will have filled a vessel on the basis of the mean value, averages the predicted times for completion of filling thus calculated to provide a corrected predicted time for completion of filling, and stops the filling of liquid into the vessel when the time passed since the commencement of filling reaches the corrected predicted time for completion of filling.

10. A filling apparatus according to claim 9 in which the controller determines the mean value by averaging a plurality of consecutive measurements.

11. A filling apparatus according to claim 9 in which the controller determines the mean value by averaging a mean value over previous measurements and a current measurement.

12. A filling apparatus including a pressure tank serving as a reservoir of liquid, means for pressurizing the liquid in the pressure tank, a plurality of filling mechanisms each in communication with the pressure tank and each having an open/close valve, a controller for controlling the operation of the filling mechanisms, and a liquid pressure sensor for detecting the liquid pressure and feeding it to the controller, the controller opening the open/close valves of the plurality of filling mechanisms to commence a filling of liquid into vessels, calculating a predicted time for completion of filling when a given quantity of liquid to be filled will have filled a vessel on the basis of a predetermined function of a liquid pressure and a filling time, and stopping the filling of liquid into the vessel by closing the open/close valve of the associated filling mechanism when the time passed since the commencement of filling reaches the predicted time for completion of filling;

characterized in that the controller measures the liquid pressure at successive points after the commencement of the filling of liquid into the vessel, calculates and recalculates a predicted time for completion of filling when a given quantity of liquid to be filled will have filled a vessel on the basis of the pressures measured, averages the predicted times for completion of filling which are calculated or recalculated at the end of each measurement to provide a corrected predicted time for completion of filling, and stops the filling of liquid into the vessel when the time passed since the commencement of filling reaches the corrected predicted time for completion of filling.

13. A filling apparatus including a pressure tank serving as a reservoir of liquid, means for pressurizing the liquid in the pressure tank, a plurality of filling mechanisms each in communication with the pressure tank and each having an open/close valve, a controller for controlling the operation of the filling mechanisms, and a liquid pressure sensor for detecting the liquid pressure and feeding it to the controller, the controller opening the open/close valves of the plurality of filling mechanisms to commence a filling of liquid into vessels, calculating a predicted time for completion of filling when a given quantity of liquid to be filled will have filled a vessel on the basis of a predetermined function of a liquid pressure and a filling time, and stopping the filling of liquid into the vessel by closing the open/close valve of the associated filling mechanism when the time passed since the commencement of filling reaches the predicted time for completion of filling;

characterized in that the controller measures the liquid pressure at successive points after the commencement of filling liquid into the vessel, determines, at the end of each measurement, a mean value of liquid pressures which have been previously measured, determines a predicted time for completion of filling when a given quantity of liquid to be filled will have filled a vessel on the basis of the mean value, and stops the filling of the liquid into the vessel when the time passed since the commencement of filling reaches the predicted time for completion of filling.

14. A filling apparatus according to claim 9, further comprising a liquid temperature sensor for measuring a liquid temperature and feeding a signal representing a liquid temperature to the controller, the function including a contribution of a change in the liquid temperature.

* * * * *